United States Patent [19]

Rek

[11] 4,049,687

[45] Sept. 20, 1977

[54] PROCESS FOR THE SEPARATION OF TRIGLYCERIDES IN AN AQUEOUS SYSTEM

[75] Inventor: Johannes Henricus Maria Rek, Vlaardingen, Netherlands

[73] Assignee: Lever Brothers Company, New York, N.Y.

[21] Appl. No.: 639,153

[22] Filed: Dec. 9, 1975

Related U.S. Application Data

[63] Continuation of Ser. No. 508,772, Sept. 24, 1974, abandoned, which is a continuation of Ser. No. 334,533, Feb. 22, 1973, abandoned.

[30] Foreign Application Priority Data

| | | |
|---|---|---|
| Feb. 24, 1972 | United Kingdom | 8647/72 |
| Feb. 24, 1972 | United Kingdom | 8648/72 |
| Sept. 12, 1972 | United Kingdom | 42393/72 |
| Sept. 12, 1972 | United Kingdom | 42397/72 |

[51] Int. Cl.[2] ..... C11B 7/00; C11B 3/00

[52] U.S. Cl. ..... 260/428; 260/420

[58] Field of Search ..... 260/428

[56] References Cited

U.S. PATENT DOCUMENTS

| | | | |
|---|---|---|---|
| 2,800,493 | 7/1957 | Steim et al. | 260/428 |
| 3,290,340 | 12/1966 | Wooton | 260/428 |
| 3,360,533 | 12/1967 | Wooton | 260/428 |

FOREIGN PATENT DOCUMENTS

| | | | |
|---|---|---|---|
| 724,222 | 2/1955 | United Kingdom | 260/428 |

*Primary Examiner*—Patrick P. Garvin
*Assistant Examiner*—P. E. Konopka
*Attorney, Agent, or Firm*—Melvin H. Kurtz

[57] ABSTRACT

A process for the separation, using an aqueous system, of liquid and solid triglycerides is improved by using an oil-soluble surface active agent, particularly an unsaturated $C_{12-28}$ monoglyceride, and a water-soluble surface-active agent, particularly a decyl sulphate or a soap of a $C_{6-10}$ saturated or a $C_{12-28}$ unsaturated fatty acid. The soap is preferably solubilized in the triglycerides before the solid fraction is formed by cooling. The process gives better and more consistent yields of olein, particularly in low-temperature separations.

4 Claims, No Drawings

PROCESS FOR THE SEPARATION OF TRIGLYCERIDES IN AN AQUEOUS SYSTEM

This is a continuation, of application Ser. No. 508,772, filed Sept. 24, 1974 now abandoned, which is a continuation of Ser. No. 334,533, filed Feb. 22, 1973, now abandoned.

The invention relates to the fractionation of fatty acid triglycerides.

The three best known methods of fractionating fatty acid triglycerides are dry fractionation, solvent-fractionation and fractionation using aqueous surface-active solutions, for convenience here called aqueous fractionation. Dry fractionation is the simplest and longest-established method but has the disadvantage that the cleaning and replacement of the filters involves much dirty manual-work. Also, particularly in fractionation at low temperatures or when small crystals are formed, filtering can become almost impossible. Of the other two methods, solvent-fractionation is too expensive except for preparing special fats. There remains aqueous fractionation.

Aqueous fractionation involves the use of water containing inorganic salt and surface-active agent with a partly crystallized oil. A dispersion is formed of the crystals in the water and by separation of the oil and water layers the crystals can be separated from the oil. Various aspects of aqueous fractionation are described in for example, Henkel U.S. Pat. No. 2,800,493, German Pat. specification No. 977,544 and the specifications of German Pat. application Nos. 1,256,645, 1,102,739 and 1,418,884. Reference can be made to these specifications for details of aqueous fractionation. The process is in principle extremely simple but in practice speed of crystallization, form of crystals, occlusion of oil in the crystals and often inexplicable and unpredictable effects complicate the process. Such problems are very particularly severe at low temperatures and when small crystals are formed.

It has now been found that the use of both a water-soluble surface-active agent and an oil-soluble surface-active agent surprisingly improves aqueous fractionation: improved yields of the liquid fraction (the olein) are obtained.

The invention therefore provides a process for separating a mixture of liquid and crystalline fatty acid triglycerides into fractions of different melting points by mixing the mixture with water to disperse the crystalline fraction in the water and separation (preferably centrifugal separation as described in the above Henkel patent specifications) of the liquid fraction and the water containing the dispersed crystalline fraction, in which surface-active agents are present to aid dispersion of the crystalline fraction, characterized in that both a water-soluble surface-active agent with an HLB value above 10 and an oil-soluble surface-active agent with an HLB value below 5 are present in concentrations such that the surface-tension at the triglyceride-aqueous interface is below 0.5 dyne/cm.

The concentrations of the water-soluble surface-active agent and of the oil-soluble surface-active agent required according to the present invention can be determined readily by experiment: A graph of surface-tension at the interface between the mixture of triglycerides and the water is plotted against concentrations of the oil-soluble surface-active agent at a fixed concentration of the water-soluble surface-active agent. The concentrations are preferably such that the surface-tension is below 0.1 dyne/cm. It should be noted that the concentrations will be dependent on the particular mixture of triglycerides, on the particular surface-active agents and on the aqueous system used, for example on the presence or absence of salts.

Examples of suitable water-soluble surface-active agents are mentioned in the Henkel patent specifications referred to above.

Preferably oil-soluble surface-active agent is added to the mixture of triglycerides but addition to the water is also possible. The amount to be added can be determined by measuring the surface-tension as indicated above. The amount will be dependent on the same factors as indicated but also on the amount of oil-soluble surface-active agent already present in the mixture of triglycerides; here attention is particularly drawn to the presence particularly in crude and in interesterified mixtures of triglycerides of oil-soluble surface-active agents and, at least in mixtures interesterified with alkali-metals, of water-soluble surface-active agents. The oil-soluble surface-active agent should preferably be added before the crystalline fraction is formed. The crystalline fraction is normally formed by cooling as explained in the Henkel patent specifications referred to above.

It has further been found that for the process according to the present invention especially preferred oil-soluble surface-active agents are unsaturated monoglycerides of $C_{12-28}$ unsaturated fatty acids, particularly oleoyl, linoleoyl and linolenoyl monoglycerides. As a guide the amount of unsaturated monoglyceride to be added can be considered to be at least 1%, preferably at least 1.5%, when refined triglycerides are used and preferably at least 0.5% when crude or interesterified triglycerides are used.

The use of unsaturated monoglycerides is particularly advantageous with Lanza-fractionation below 25° C, especially below 10° C.

It has further been found that the water-soluble surface-active agent should preferably be a water-soluble decyl sulphate, preferably sodium decyl sulphate, when the fractionation occurs below 25° C.

In an especially preferred form of the process according to the invention water-soluble surface-active agent is added to or generated in the mixture of triglycerides and is solubilize, e.g. micellularly, before the crystalline fraction has been formed. The yield of olein and, especially, the reproducibility of the process are improved. The amount of the water-soluble surface-active agent added to or generated in the mixture should preferably be at least 0.3%, based on the mixture. The water-soluble surface-active agent can advantageously be solubilized in the mixture of triglycerides by oil-soluble surface-active agent. The water should preferably be mixed with the mixture of triglycerides after the crystalline fraction has been formed.

It has further been found that preferred water-soluble surface active agents, when the agent is added to or generated in the mixture before the crystalline fraction has been formed, are water-soluble soaps of $C_{6-10}$ saturated fatty acids and, particularly preferably, of $C_{12-28}$ unsaturated fatty acids.

Suitable soaps are lithium and sodium, preferably potassium and ammonium soaps. Especially preferred soaps are of oleic, linoleic and linolenic acids. The amount of soap should preferably be above 0.6%. A convenient upper limit will depend on solubility; this is, for instance, for potassium oleate in groundnut oil about 2%.

When the water-soluble surface-active agent is a soap, the inorganic salts used in the water are preferably soluble salts of monovalent cations, for example NaCl, $K_2SO_4$, $NaNO_3$, $NH_4NO_3$ and KCl.

The water-soluble surface-active agent is advantageously generated in situ, for instance by adding potassium carbonate to a mixture of triglycerides that contains free fatty acids. The mixture should preferably be stirred well during the addition. For instance it has been found that less unsaturated monoglyceride and less soap are required using this modification than when the soap is added to the mixture.

The triglycerides to which the invention can be applied are freferably glycerides of $C_{10-32}$, preferably $C_{12-24}$, fatty acids (e.g. straight chain, saturated or unsaturated carboxylic acids).

Examples of mixtures of triglycerides to which the invention can be especially advantageously applied are groundnut oil, partly hardened soyabean oil, palm oil, cottonseed oil and butter, particularly butter olein. The amount of inorganic salts will conveniently be between, based on the water, 1 and 15%, preferably between 2.5 and 5%. When the water-soluble surface-active agent is added to the water the inorganic salts are preferably, as explained in the Henkel patent specifications referred to above, water-soluble salts of polyvalent cations. The volume ratio of water to mixture of triglycerides should preferably in between 0.1 to 1.0:1, especially 0.2 to 0.8:1.

In this specification all figures and ratios are by weight unless stated otherwise.

The invention will now be illustrated further by the following examples and comparative tests.

EXAMPLE 1

2% unsaturated monoglycerides(Myverol 18–98 i.e. molecularly distilled monoglycerides of safflower oil containing 90–95% unsaturated monoglycerides from oleic, linoleic and linolenic acids; obtained from Eastman Kodak) and 0.6% potassium oleate were dispersed in 992 g refined groundnut oil at elevated temperature with a stirrer. Then the oil was crystallized for 18 h in a jacketed vessel without stirring at 0° C. Then stirring was started with a ribbon stirrer (25 rpm) and a dispersion was prepared with an aqueous solution of 5% $Na_2SO_4$ at a dispersion ratio of 0.6 : 1. Stirring was continued for 1 h and 75% olein was recovered by centrifuging for 5 min at 4,000 g.

EXAMPLE 2

Example 1 was repeated with 981 g oil except that the crystallization was carried out with stirring (25 rpm).

A 77% yield of olein was obtained.

Repetition of Example 2 a number of times gave consistent yields of olein of between 75 and 80%.

EXAMPLE 3

Example 1 was repeated except that no potassium oleate was added to the oil and that the aqueous solution contained, instead of 0.5% $Na_2So_4$, 0.5% sodium decylsulphate and 2% $MgSO_4$-$7H_2O$.

A 55% yield of olein was obtained.

EXAMPLE 4

Example 3 was repeated with 1016 g oil except that the crystallization was carried out with stirring (25rpm).

A 77% yield of olein was obtained.

Repetition of Example 4 a number of times gave yields of olein of between 45% and 80%.

EXAMPLES 5 to 14

Table I shows the influence of the concentration of potassium oleate, unsaturated monoglyceride (Myverol 18–98), percentage of $Na_2SO_4$ and the dispersion ratio on the yield of olein and on the cold-test (clear on storage at 0° C). Crystallization of about 150 g samples of refined groundnut oil occurred during 18 h at 0° C without stirring.

The potassium oleate and the unsaturated monoglyceride (mono) were added to the oil before crystallization. After crystallization a dispersion was prepared by adding the aqueous phase with stirring with a gate stirrer (40 rpm) and stirring was continued for 1 h. Finally the dispersion was centrifuged for 5 min at 4000 g.

TABLE I

| | In oil | | | Ratio | % | |
|---|---|---|---|---|---|---|
| Ex. | %K-oleate | % mono | % $Na_2SO_4$ in water | water : oil (volume) | olein yield | Clear at 0° C (h) |
| 5 | 1.0 | 1.5 | 5 | 0.6 : 1 | 63 | > 200 |
| 6 | 1.0 | 2.0 | 5 | 0.6 : 1 | 76 | > 200 |
| 7 | 1.0 | 2.5 | 5 | 0.6 : 1 | 72 | > 200 |
| 8 | 0.6 | 2.0 | 5 | 0.6 : 1 | 79 | > 200 |
| 9 | 1.5 | 2.0 | 5 | 0.6 : 1 | 75 | > 200 |
| 10 | 0.6 | 2.0 | 5 | 0.2 : 1 | 81 | > 40 |
| 11 | 0.6 | 2.0 | 5 | 0.4 : 1 | 79 | > 200 |
| 12 | 0.6 | 2.0 | 5 | 0.8 : 1 | 77 | > 40 |
| 13 | 0.6 | 2.0 | 2.5 | 0.4 : 1 | 77 | > 200 |
| 14 | 0.6 | 2.0 | 5 | 0.4 : 1 | 81 | > 200 |
| Starting refined groundnut oil | | | | | | < 12 |

EXAMPLE 15

1% unsaturated mono-glyceride (Myverol 18–98) and then 1% potassium carbonate were added to 500 g crude palm oil containing 6& oleic acid. The oil was allowed to crystallize at 18° C for 36 hours and then mixed with an equal volume of 5% $Na_2SO_4$ solution. On centrifuging a 33% yield of olein was obtained.

EXAMPLE 16

Example 15 was repeated except that no potassium carbonate was added to the oil and that after crystallization an aqueous solution was used containing 0.5% sodium dodecyl sulphate and 2% $MgSO_4$.aq instead of the 5% $Na_2SO_4$. On centrifuging a 19% yield of olein was obtained.

EXAMPLES 17 to 21

In Examples 17 to 21 and Comparative Tests A and B about 900 g soyabean oil hardened to the following dilatation values were aqueous fractionated: $D_0=180$, $D_{10}=160$, $D_{15}=100$, $D_{20}=70$, $D_{25}=50$, $D_{30}=20$ and $D_{35}=10$. In each experiment Myverol 18–98 and, except in Comparative Test A, potassium oleate was added to the oil with vigorous stirring. The oil was then allowed to crystallize at 0° C for 18 hours without stirring. After addition of 60% by volume of aqueous solution A or B, see below Table II, the mixture was stirred (time for dispersion in Table II) and then the olein was separated centrifugally.

Table II shows results obtained from Examples 17 to 21 and Comparative Tests A and B.

TABLE II

| Example or Comparative Test | Added to Oil Mono % | Potassium Oleate % | Time for Dispersion Hours | Aqueous Solution | % Yield of Olein |
|---|---|---|---|---|---|
| 17 | 1 | 1.5 | 1.5 | A[1] | 61 |
| 18 | 1 | 1 | 1.5 | A | 73 |
| 19 | 1 | 1 | 1.5 | A | 70 |
| 20 | 0.5 | 1 | 1.5 | A | 63 |
| 21 | 1 | 0 | 1 | B[2] | 45 |
| A[3] | 0.35 | 0 | 1 | B | 0 |
| B[3] | 0.35 | 1.5 | 1.5 | A | 0 |

[1]5% $Na_2SO_4$
[2]0.5% sodium decyl sulphate and 2% $MgSO_4 . 7H_2O$
[3]Insufficient mono

EXAMPLES 22 to 29 and Comparative Test C

Butter fat was aqueous fractionated at 20° C to give an olein (40%) and a stearine (60%). The stearine had the following dilatations: $D_0=1230$, $D_{10}=1200$, $D_{15}=1035$, $D_{20}=810$, $D_{25}=650$, $D_{30}=480$ and $D_{35}=280$. The olein had the following dilatations: $D_0=800$, $D_{10}=550$, $D_{15}=270$ and $D_{20}=20$. The olein was used in the following Examples 22 to 29 and Comparative Test C.

EXAMPLE 22

1 g unsaturated monoglyceride (Myverol 18-98) and 1% potassium oleate were thoroughly stirred into 500 g of the butter-olein. The olein was then allowed to crystallize at 10° C overnight without stirring. The oil was then added to 500 cc of 5% $Na_2SO_4$ solution, in which it was stirred for 1 hour. On centrifuging a 36% yield of olein was obtained that was clear after 48 hours at 10° C.

EXAMPLE 23

Example 22 was repeated. The same result was obtained.

EXAMPLES 24 to 28

Table III gives results obtained from the Examples 24 to 28 and Comparative Test C with the above butter-olein. Except as indicated in the Table the conditions of Example 22 were used.

TABLE III

| Example or Comparative Test | % Added to Oil Mono | Sodium Decyl Sulphate | Potassium Oleate | Time for Crystallization | Aqueous Solution | % Yield of Olein |
|---|---|---|---|---|---|---|
| 24 | 0.5 | 0 | 1 | overnight | B[2] | 9 |
| 25[5] | 1 | 0 | 0 | overnight | C[3] | 28 |
| 26 | 0.5 | 0 | 1.5 | overnight | B[2] | 5 |
| 27 | 1 | 0 | 0 | overnight | C[3,4] | 35 |
| C[5] | 1 | 1 | 0 | 3 days | A[1] | 0 |
| 28 | 1 | 0 | 0 | overnight | C[3] | 26 |

[1]2% $MgSO_4 . aq$ + 1% $Al_2(SO_4)_3 . aq$
[2]5% $Na_2SO_4$
[3]0.5% sodium decyl sulphate, 2% $MgSO_4 . 7H_2O$ and 1% $Al_2(SO_4)_3 . 15H_2O$
[4]Volume ratio water to oil was 0.6.
[5]With sodium decyl sulphate addition to the oil does not reduce the surface-tension at the oil/water interface sufficiently.

EXAMPLES 29 to 33

In Table IV is shown the influence of the concentration of unsaturated mono-glyceride (Myverol 18-98) on aqueous fractionation of partially hardened soyabean oil as used in Examples 17 to 21.

100 g samples of the soyabean oil were heated at 60° C with the unsaturated monoglyceride and allowed to cool without stirring to 0° C in a constant-temperature cabinet maintained at 0° C. The samples were kept at 0° C for 48 h. Aqueous fractionation was then carried out at 0° C using an aqueous solution containing 0.5% sodium decyl sulphate and 2% $MgSO_4.7H_2O$. The volume ratio of water to oil was 0.4:1. The aqueous solution was added to the oil within 5 min. with stirring and stirring was continued for 1 h. After centrifuging at 4500 g gravity for 5 min. the olein yield was determined

TABLE IV

| Example No. Comparison | % Mono | % Olein |
|---|---|---|
| D | 0.2 | 0 |
| 29 | 0.5 | 40 |
| 30 | 0.7 | 52 |
| 31 | 1.0 | 63 |
| 32 | 1.5 | 64 |
| 33 | 2.0 | 56 |

EXAMPLE 34

350 kg of butter that had been stored in a cold store for 2 years were melted in an open vessel at 60° C. After 4 h at 60° C the water layer that had formed was separated (25 kg). The oil was then washed twice with water (50 kg containing 10% NaCl). The oil was then dried under vacuum at 60° C and filtered. 270 kg of butterfat was obtained.

125 kg of the butterfat at 55° C was mixed with 1.4 kg unsaturated monoglyceride (Myverol 18-98) in a 200 l wall-scraped vessel. The mixture was cooled in 150 min. to 20° C and stabilized for 19 h at 20° C. 50 kg of an aqueous solution was added at 0.55 kg/min. The aqueous solution contained 0.5% sodium dodecyl sulphate, 2% $MgSO_4.7H_2O$ and 1% $Al_2(SO_4)_3$ added as a 10% solution. 15 l of water were then added to bring the dispersion ratio to 0.6:1 water:oil. On centrifuging a 62% yield of olein was obtained.

I claim:

1. A process for the separation of a mixture of liquid and crystalline fatty acid triglycerides of different melting points, the process comprising the steps in the following order:

a. contacting the glyceride mixture, at a temperature at which all the triglycerides thereof are liquid, with a mixture of oil-soluble and water-soluble surface-active agents which is sufficient to decrease the surface-tension at the triglyceride-aqueous interface of the triglycerides in contact with water to a value below 0.5 dyne/cm at the separation temperature, said oil-soluble surface-active agent selected from the group consisting essentially of oleoyl, linoleoyl and linolenoyl monoglycerides and the water-soluble surface-active agent selected from the group consisting essentially of an alkali metal decyl sulphate, an alkali metal salt of a $C_{6-10}$ saturated fatty acid or a $C_{12-28}$ unsaturated fatty acid;

b. crystallizing the triglycerides at the temperature at which separation is effected and the liquid and crystalline fatty acid triglycerides to be separated coexist;

c. contacting the mixture of triglycerides and surface-active agents at the separation temperature with sufficient water to form a dispersion of the crystalline fraction in the water added in the form of about 1 to about 15% of an inorganic salt solution;

d. separating the liquid triglyceride fraction and the water containing the dispersed crystalline fraction, and e. recovering the crystalline fraction therefrom, the oil-soluble surface-active agent and the water-soluble surfaceactive agent.

2. Process according to claim 1 in which the water-soluble surface-active agent comprises a soluble amount of above 0.6% of a potassium salt of oleic, linoleic or linolenic acid.

3. Process according to claim 1 in which the mixture of triglycerides is selected from groundnut, partly-hardened soybean, palm and cottonseed oil and butter.

4. Process according to claim 1 in which the mixture of glycerides contains free fatty acid and alkali metal carbonate is added to react therewith whereby the water-soluble surface-active agent comprising the alkali metal salt of said fatty acid is formed in situ.

* * * * *